United States Patent [19]

Travis et al.

[11] Patent Number: 5,069,691

[45] Date of Patent: Dec. 3, 1991

[54] PORTABLE FILTRATION UNIT

[75] Inventors: Terrell Travis, Alpharetta; David Shagott, Duluth, both of Ga.; Gary Kruse, Lincoln University, Pa.; Daniel Sutherland; Blair Harber, Jr., both of Ontario, Canada

[73] Assignee: Abatement Technologies, Duluth, Ga.

[21] Appl. No.: 613,212

[22] Filed: Nov. 14, 1990

[51] Int. Cl.[5] ..... B01D 50/00

[52] U.S. Cl. ..... 55/126; 55/467; 55/482; 55/484; 55/356; 55/350

[58] Field of Search ..... 55/482, 484, 316, 124, 55/126, 356, 387, 320, 323, 324, 342, 467, 350

[56] References Cited

U.S. PATENT DOCUMENTS

| | | | |
|---|---|---|---|
| 324,575 | 8/1885 | Mertsheimer et al. | 55/465 |
| 925,626 | 6/1909 | Dion | 55/124 |
| 3,812,370 | 5/1974 | La Violette | 55/316 |
| 3,926,596 | 12/1975 | Coleman | 55/304 |
| 4,017,281 | 4/1977 | Johnstone | 55/334 |
| 4,306,893 | 12/1981 | Fernando et al. | 55/302 |
| 4,590,884 | 5/1986 | Kreeger et al. | 118/308 |
| 4,935,984 | 6/1990 | Bryant et al. | 15/302 |
| 4,968,333 | 11/1990 | Ellis et al. | 55/341.1 |

FOREIGN PATENT DOCUMENTS

| | | | |
|---|---|---|---|
| 2459356 | 6/1975 | Fed. Rep. of Germany | 55/124 |

OTHER PUBLICATIONS

Aqualine Resources, Inc. "Master Vac" Brochure, Nov. 1990.

Health Aire Company, Inc. PV4000 Brochure, Oct. 25, 1990.

Vac Systems Industries Advertisement and Brochure, Oct. 1990.

Pringle Co. "Power-Vac" Brochures, Jul. 1990.

Brochure for U.S. Industrial Company's OMNI/H-VAC Duct Cleaning System, Feb. 1991.

Jan. 1991 Advertisement and Brochure for "Vent Vac" Duct Vacuum.

Jan. 1991 Advertisement and Brochure for "Mechaniclean" Duct Cleaner System.

*Primary Examiner*—Bernard Nozick

*Attorney, Agent, or Firm*—Kilpatrick & Cody

[57] ABSTRACT

A portable vacuum and air filtration unit, comprising: a plurality of separately transportable modules and a means for locking the modules together during use, an air inlet located in one of the modules, a debris screen and a means for receiving debris stopped by the screen located in one of the modules, an electrostatic filter located in one of the modules, a bag filter assembly located in one of the modules, a HEPA filter assembly located in one of the modules, and a means for drawing a substantial volume of air through the inlet, screen, electrostatic filter, bag filter assembly and HEPA filter assembly.

2 Claims, 6 Drawing Sheets

PORTABLE FILTRATION UNIT

BACKGROUND OF THE INVENTION

The present invention relates to portable filtration units for cleaning heating, ventilation, and air conditioning ("HVAC") ductwork in residential and commercial buildings. Such cleaning is often needed, particularly in older buildings, to remove accumulations of dust, dirt, and other debris that collect in the ductwork and can cause allergic reactions or pose other health and safety risks.

Generally, HVAC duct cleaning has been accomplished using large, truck-mounted vacuum units. These vacuum units are driven by a power takeoff from the truck engine and typically generate air flow of 10,000 to 20,000 cubic feet per minute ("CFM") at the truck. Of course, the truck must normally be parked outside a convenient doorway into the building, and the building ductwork is connected to the truck mounted vacuum unit by a long, flexible, temporary duct or hose. Because of losses in the flexible duct, the airflow generated at the input end of the flexible duct typically drops significantly to around 5000 to 8000 CFM or less.

In use, once the vacuum unit is connected to the building ductwork, a wand or "skipper" is inserted into and passed through the building ductwork. The skipper is connected to an air compressor and has a head with multiple air jets. Compressed air forced through the skipper air jets and directed toward the vacuum unit loosens, agitates and suspends in the air dirt and dust in the ductwork and blows other debris toward the vacuum unit. The suction generated by the vacuum unit pulls the suspended dirt, dust and debris into the truck and blows it through cloth bag filters, which typically trap only 40% to 60% of the dirt and dust before the remainder is exhausted with the air into the atmosphere. Cleaning all the ducts in the building can take 2 to 3 hours in a typical residence and longer in a commercial building.

There are several disadvantages associated with truck-mounted vacuum filtration units. First, such units are expensive to purchase and to operate. For example, truck mounted units require a two person crew to use. Further, because of the length of the temporary duct, truck mounted units require 1 to 2 hours to set up. Therefore, a typical crew can only clean two buildings in one day. In addition, because the vacuum unit is powered by the truck's engine, the truck must be left running during the entire cleaning operation, not only using a large quantity of gasoline or diesel fuel which the vacuum unit operator must supply, but also increasing the maintenance requirements of the truck. Finally, from the building owner's perspective, truck mounted units are exhausting 5000 to 8000 CFM of air conditioned or heated air into the atmosphere for 2 to 3 hours, which can have a large impact on the owner's utility bill.

A more important disadvantage with truck mounted vacuum units is the dust and dirt the units exhaust. With filters that are at best 40% to 60% efficient, truck-mounted vacuum units spew out large amounts of dust or dirt, most of which settles back on the building being cleaned. The filters used on these truck-mounted units are particularly ineffective (less than 10% efficient) at filtering the small, invisible particles of 10 microns or less in diameter that are often the most harmful to humans. When this dust or dirt also contains asbestos fibers (a not unusual occurrence in older buildings), or worse—pathogens like legionella or other disease causing materials—the filth sprayed about by truck mounted vacuum units can be a health risk, particularly for the operator, if not an environmental hazard.

A third disadvantage to truck mounted units is that the unit must remain outside the building, and because of losses in the flexible duct, the duct can be of only limited length. Thus, although usable for residential and low rise commercial buildings, truck mounted vacuum units cannot be used on buildings more that a few stories tall.

Finally, truck mounted vacuum units are noisy. Although the noise generated by these units may not be intrusive in an busy urban setting, the deafening roar and whine generated by truck mounted units can be intolerable on the quiet suburban residential streets where the units are typically employed.

Some of the described problems are answered by prior art portable filtration units. Currently, there are several vacuum filtration units on the market that are intended to be portable. Some of these units are operated by a gasoline engine and have many of the drawback discussed above, such as noise, expense, and the requirement of operation outside the building. There are prior portable units that are operated by electric motors; however, until the present invention, none of these units have been entirely satisfactory.

For example, one such unit is powered by a 3 horsepower electric motor and weighs less than 200 pounds. However, the electric motor of this unit requires 230 volt electric service and draws 18 amperes. Many residential or light commercial building contain no provision for 230 volt electric service in the locations where the vacuum unit must be operated. Furthermore, the airflow generated by this unit is less than 2000 CFM, which is insufficient to thoroughly clean HVAC ductwork. Finally, most important, this unit also uses inefficient cloth filtration bags, which results in most of the dust and dirt collected by the unit being exhausted back into the building being cleaned or adjoining buildings.

A second electric unit currently on the market is powered by two 5 horsepower 208/230 volt electric motors, which are also unsuitable for residential and light commercial buildings. Furthermore, the unit has two parts; one weighs 150 pounds, and the other weighs 350 pounds. The weight of this unit reduces its portability and requires a two person crew. This unit does generate an airflow of 4000 to 5000 CFM and the filtering system includes a high efficiency particulate air ("HEPA") filter.

A third unit currently on the market includes a HEPA filter, runs on 110 volts, and is of a modular design. However, the electric motors on this unit draw 70 amperes, and render the unit virtually unusable in residential or light commercial buildings where the typical electric circuit is 15 amperes.

SUMMARY OF THE INVENTION

The present invention solves the problems of the prior art in a portable filtration unit that contains four separate, easily maintained filters; a large particle filter, a cleanable and reusable electrostatic filter, a bag filter, and a HEPA filter. This cascade of filters exhausts almost totally clean air while successfully dealing with the astoundingly wide range of debris found in HVAC ductwork. The unit is powered by multiple 110 volt electric motors, each drawing less than 15 amperes. The blowers attached to the electric motors generate a total airflow of at least 4000 CFM. The filtration unit is of wheel-mounted, modular design, with the motors, blowers and filters housed in separate, easily connected compartments. The unit is easily transported to the HVAC system to be cleaned and can be quickly set up by a single person.

Accordingly, one objective of the present invention is to provide an inexpensive filtration unit.

Another objective of the present invention is to provide a portable filtration unit.

A further objective of the present invention is to provide a filtration unit that can be easily transported and set up by a single person.

Still another objective of the present invention is to provide a filtration unit which is suitable for use in high rise commercial buildings.

Still another objective of the present invention is to provide a filtration unit that operates on standard household electric current.

A further objective of the present invention is to provide a filtration unit which contains a HEPA filter.

Still another objective of the present invention is to provide a filtration unit that is modular.

A further objective of the present invention is to provide a filtration unit in which filter life is maximized and operating costs minimized.

Still another objective of the present invention is to provide a filtration unit which provides a deflector baffle which will prevent objects drawn into the unit from being propelled through the unit thereby damaging the filters.

These and other objectives and advantages of the present invention will become apparent from the detailed description and claims which follow.

DETAILED DESCRIPTION OF THE DRAWINGS

Figure 1:
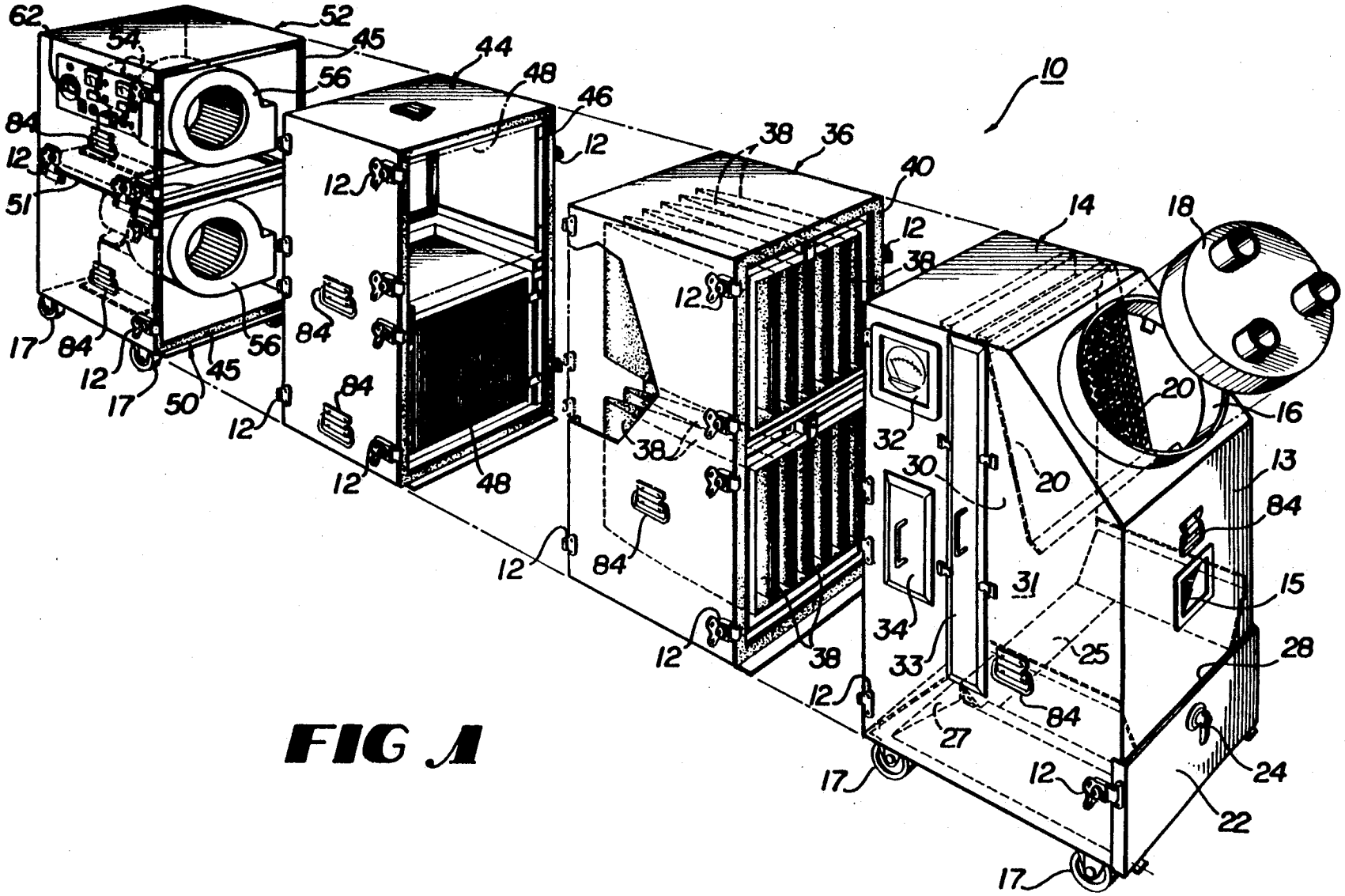
FIG. 1 is an exploded perspective view of one embodiment of the present invention.
Figure 2:
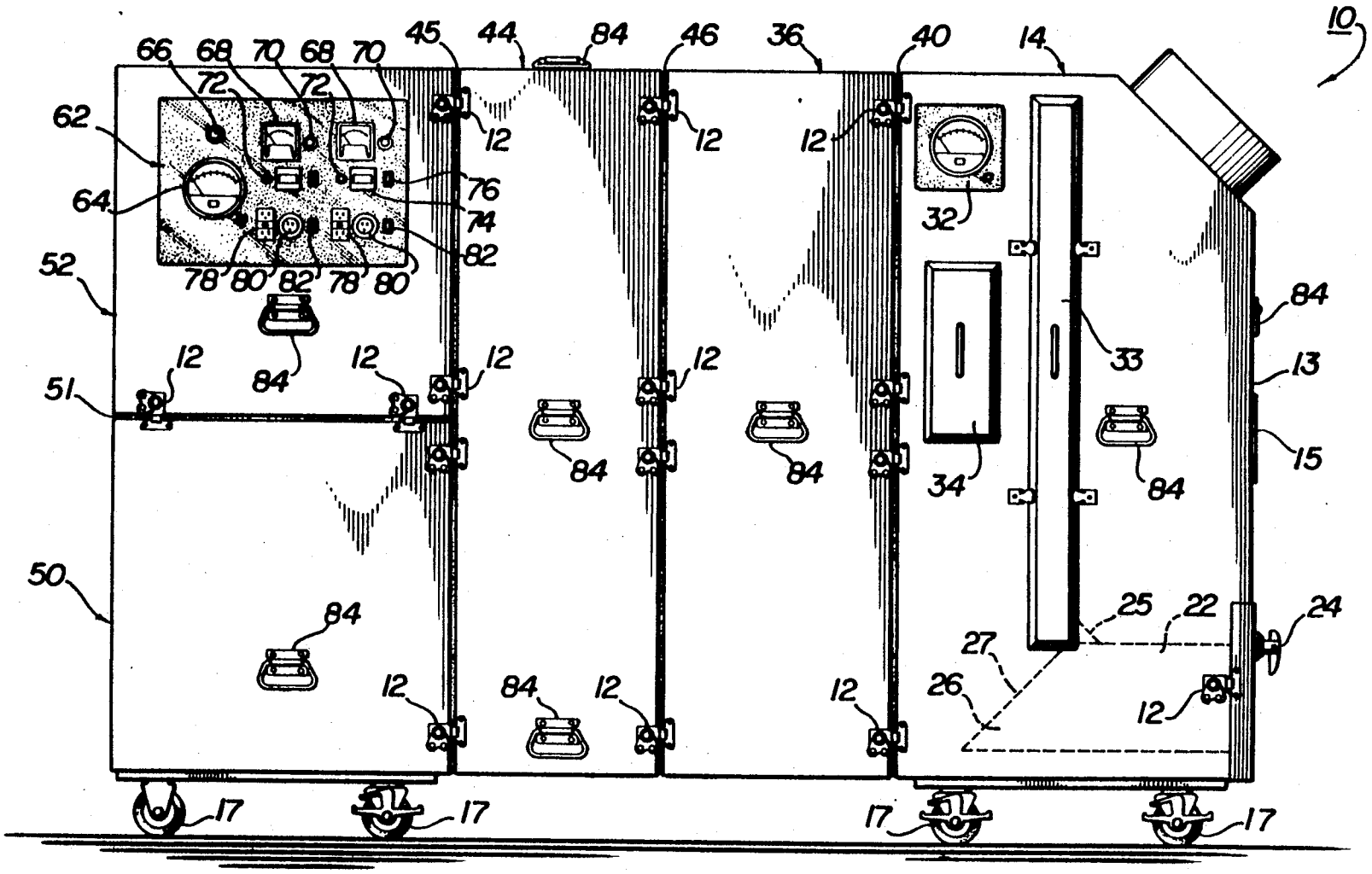
FIG. 2 is an elevation of the embodiment of the present invention shown in FIG. 1.
Figure 3:
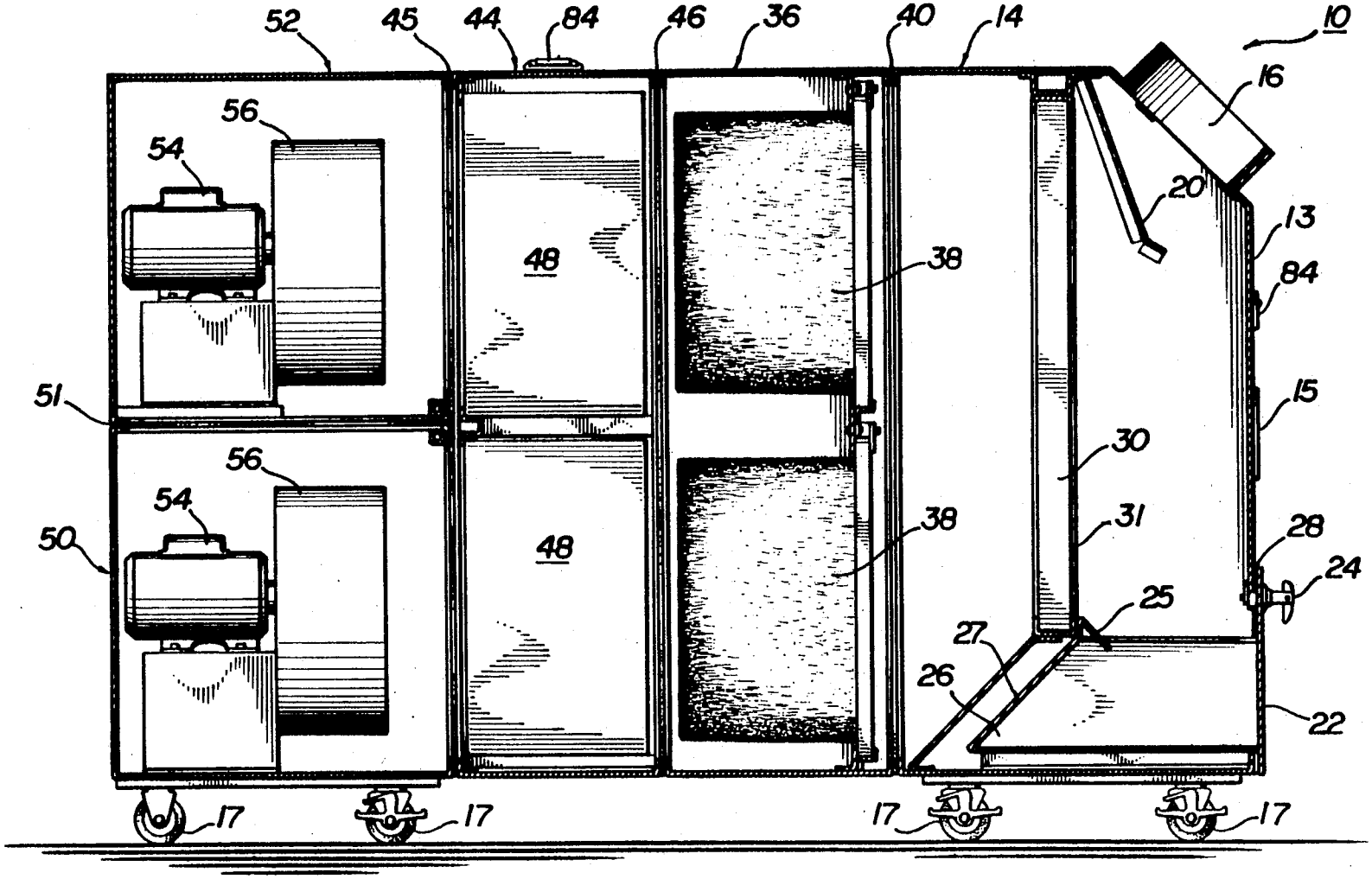
FIG. 3 is a longitudinal cross section taken substantially through the center of the unit shown in FIGS. 1 and 2.
Figure 4:
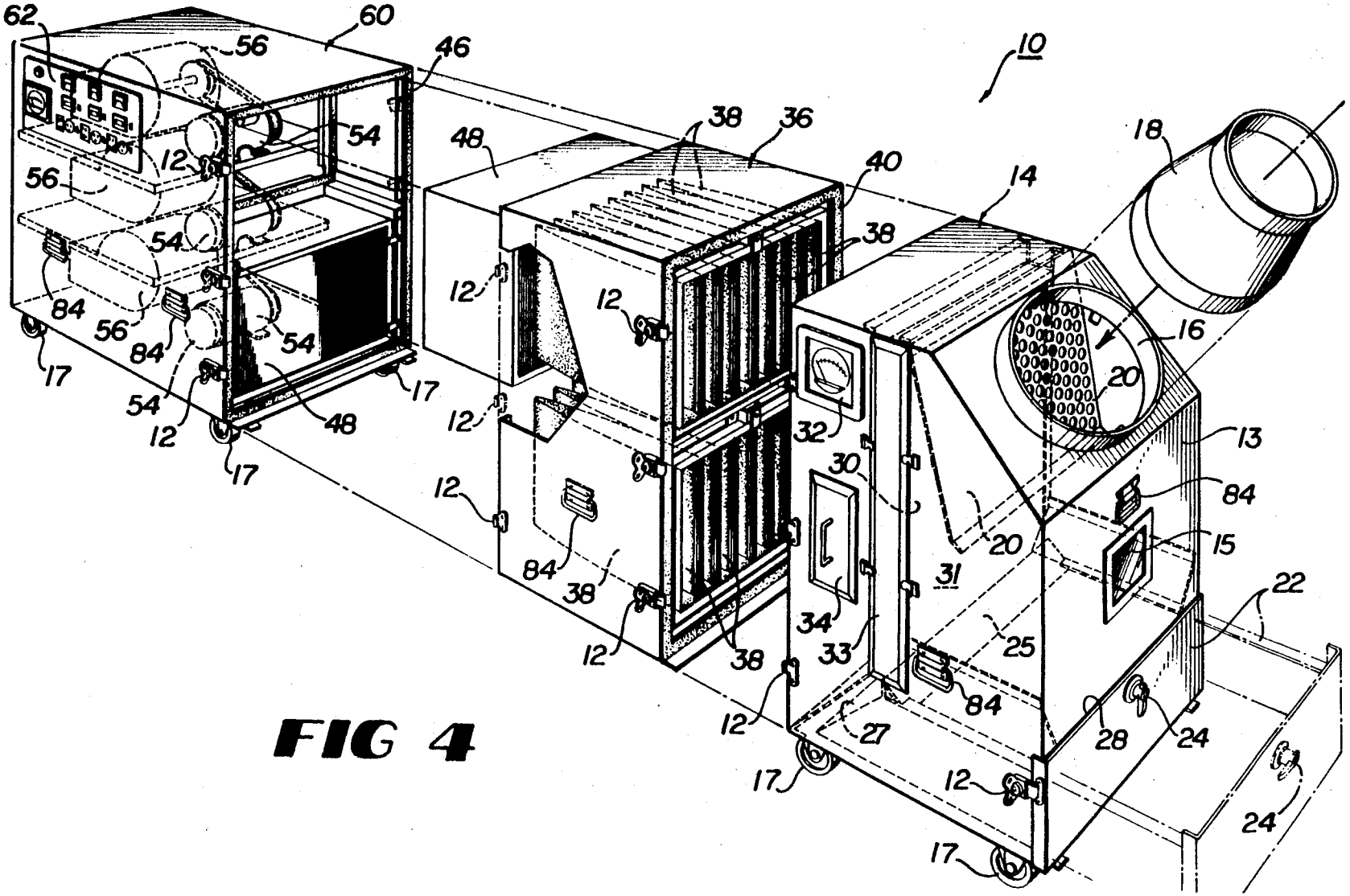
FIG. 4 is an exploded perspective view of a second embodiment of the present invention.

As can be seen in FIGS. 1, 2, 3, 4, 5, and 6, the filtration unit 10 has several chest-like modules which are easily maneuvered using carrying handles 84 and are connected for use by cam locks 12. The first inlet module 14 and all other sheet components of unit 10, except as otherwise noted, are preferably made of steel, stainless steel, aluminum, or aluminum alloy. Inlet module 14 includes an air inlet 16, which is preferably at a 45° angle and to which duct connector 18 is attached, rests on castors 17 which swivel 360° and can be locked, and is moved using carrying handles 84. Duct connector 18 is preferably made of steel, stainless steel, aluminum, or aluminum alloy, but other suitable materials may be used. Duct connector 18 may be straight or angled (not shown) and join a single duct inlet 16 as shown in FIG. 4 or, as shown in FIG. 1, may join multiple smaller ducts to inlet 16 for multiple vacuum inlets.

Inlet module 14 also contains particulate deflector 20, a perforated sturdy sheet positioned in the incoming airstream to deflect large debris entering inlet module 14 through inlet 16 into collection drawer 22. Drawer 22 is preferably made of steel, stainless steel, aluminum, or aluminum alloy and as can be seen in FIGS. 1 and 4, can be easily removed from inlet module 14 by pulling on locking handle 24. As can be seen in FIGS. 1, 2, 4, and 5, the rear 26 of drawer 22 forms two V-shaped areas 25 and 27 that trap particles, thereby allowing any particles entering drawer 2 to precipitate to the bottom of drawer 22 and remain there despite the turbulence above drawer 22 created by air entering inlet module 14 through inlet 16. Drawer 22 also contains a gasket 28 which in combination with locking handle 24, seals drawer 22 against front 13 of inlet module 14. Deflector 20 in combination with drawer 22 minimizes premature loading on filter 30 and bag filter 38, thereby maximizing filter life and airflow and reducing filter replacement costs.

Figure 5:
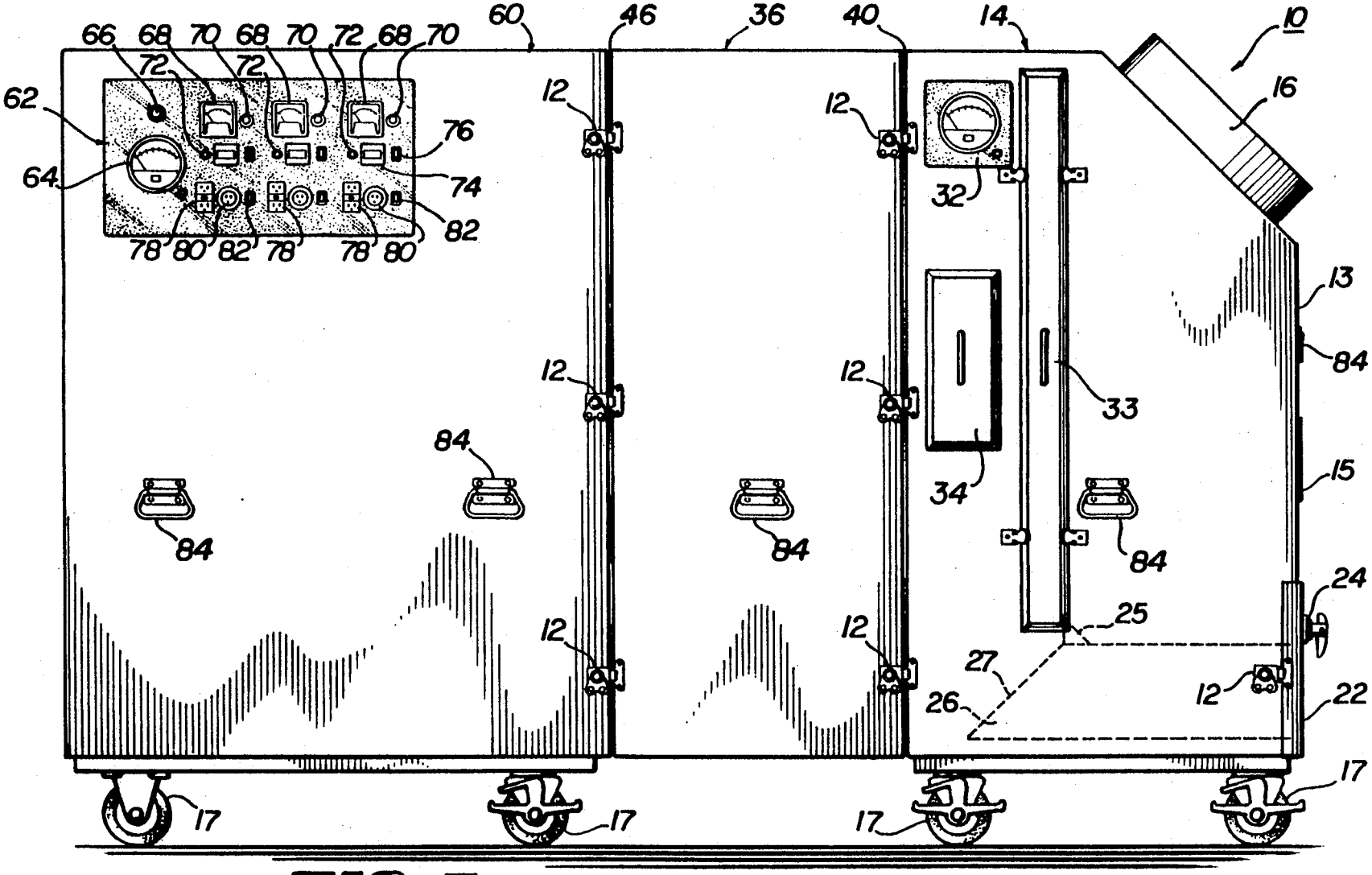
FIG. 5 is an elevation of the second embodiment of the present invention of FIG. 4.

Air entering inlet module 14 passes from the large debris-trapping chamber 11 through electrostatic prefilter 30. Electrostatic filters of the type used in unit 10 are well-known in the art and are available from companies like Air Purification of Houston. Filter 30 is accessible through filter door 33. In the event filter 30 becomes clogged, as shown by a rise in pressure differential on magnahelic gauge 32, access door 34 can be removed and filter 30 tapped or vibrated to loosen the dirt, dust, or other debris that has accumulated on the upstream side 31 of filter 30. Access door 34 is then reinstalled on inlet module 14. As can be seen in FIGS. 3 and 5, the debris so loosened from filter 30 falls into drawer 22. The condition of filter 30 can also be monitored through plexiglass window 15.

The screened and prefiltered air that has passed through filter 30 then enters bag filter module 36, which is of similar chest-like construction and attaches to inlet module 14 by cam locks 12 and is sealed by gasket 40. Bag filter module 36 contains fiberglass cloth bag filters 38. Such filters 38 are well-known in the art and are available, for instance, from Cambridge Filter Corporation. Air passing into second module 36 flows through filters 38 and exits bag filter module 36.

As can be seen in FIGS. 1, 2, and 3, in one embodiment of the present invention, the screened and filtered air exiting bag filter module 36 enters HEPA filter module 44, which is of like construction to bag filter module 36, is attached to bag filter module 36 by cam locks 12, and is sealed against bag filter module 36 by gasket 46. HEPA filter module 44 contains high efficiency particulate air ("HEPA") filters 48, which filters are also well-known in the art. Similar HEPA filters may be obtained from Cambridge Filter Corporation. Air entering HEPA filter module 44 passes through HEPA filters 48, which filter out 99.97% of the dust and dirt particles 0.3 microns or larger in size suspended in the air, and enters fan modules 50 and 52.

Fan modules 50 and 52, which are of similar construction to inlet module 14, bag filter module 36 and HEPA filter module 44, each contain an electric motor 54, which drives a centrifugal fan blower 56. Fan modules 50 and 52, attach to each other and HEPA filter module 44 by cam locks 12, and are sealed by gaskets 45 and 51.

Although the embodiment shown in FIGS. 1, 2, and 3 uses two motors 54 and two blowers 56, fewer or more motors 54 and blowers 56 can be used in sizes and configurations dictated by the air handling capacity desired. Each motor 54 should preferably run on standard 120 volt household current and draw no more than 15 amperes. A sufficient number of pairs of motor 54 and blower 56 are used to generate an airflow of at least 3500 CFM, with 4000 CFM to 6000 CFM being preferred. Fan module 52 also contains control panel 62, which controls both fan module 52 and fan module 50. Control panel 62 contains magnahelic gauge 64, which is used to monitor the airflow resistance through the entire system as duct contaminates load the filters and reduce airflow. Power loss alarms 66 sound if power is interrupted to that circuit (thereby stopping motor 54 and reducing the airflow below optimum). Amperage gauges 68 monitor the current drawn by motors 54 and blowers 5 and allow the operator to monitor each motor 54 and blower 56 pair individually, while power indicators 70 allow the operator to visually determine which motors 54 are operating, even when the operator is not standing next to the unit 10. For safety, circuit breakers 72 and power switches 76 are also provided. Hour meters 74 allow the unit owner to monitor how long each motor 54 of unit 10 has been operated. Control panel 62 also contains ground fault interrupter outlets 78 for use by the operator for accessory equipment and which also protects motors 54 from internal short circuits. Alarm bypasses 82 can be used to disengage power loss alarms 66 when desired. Unit 10 is supplied power through power connectors 80. Each motor 54 has its own power connector 80, allowing each motor 54 of unit 10 to be connected to separate 15 ampere electrical circuits. Fan modules 50 and 52 may also contain an electric limit switch (not shown) which automatically disengages power to motors 54 in the event either fan modules 50 or 52 are disconnected from each other or HEPA filter module 44. Virtually clean air entering fan modules 50 and 52 is exhausted out a baffled exhaust port (not shown) located on the side of fan modules 50 and 52 opposite control panels 62. The exhaust port (not shown) also has a door (not shown) which prevents air from entering the exhaust port in the event both motor 54 and blower 56 pairs are not operated simultaneously.

Figure 6:
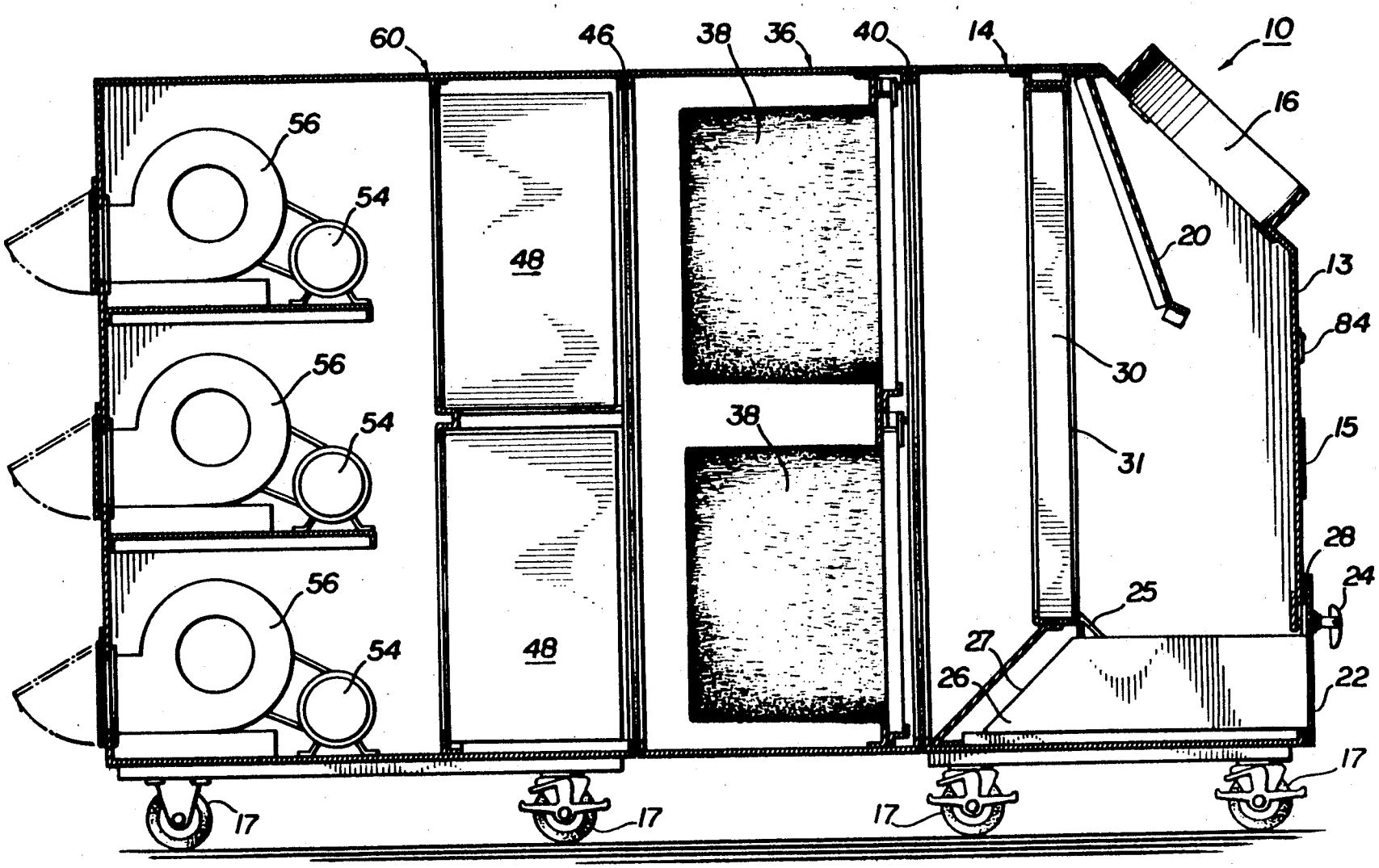
FIG. 6 is a longitudinal cross section taken substantially through the center of the unit shown in FIGS. 4 and 5.

A second embodiment of the present invention is shown in FIGS. 4, 5 and 6. In the second embodiment, screened and filtered air passing through filters 38 and exiting bag filter module 36 enters fan/HEPA module 60. Fan/HEPA module 60 contains HEPA filters 48, three pairs of motors 54 and blowers 56, castors 17, carrying handles 84, and control panel 62. Like fan modules 50 and 52, virtually clean air passing through HEPA filters 48 is exhausted out baffled exhaust ports (not shown) having doors (not shown).

This description is provided for illustration and explanation. It will be apparent to those skilled in the relevant art that modifications and changes may be made to the invention as described above without departing from its scope and spirit.

We claim:

1. A portable vacuum and air filtration unit, comprising:

a) a plurality of separately transportable modules and a means for locking the modules together during use;

b) an air inlet located in one of the modules;

c) a debris deflector and a means for receiving debris stopped by the deflector located in one of the modules;

d) an electrostatic filter located in one of the modules;

e) a bag filter assembly located in one of the modules;

f) a HEPA filter assembly located in one of the modules; and g) a means for drawing a substantial volume of air through the inlet, deflector, electrostatic filter, bag filter assembly and HEPA filter assembly.

2. A portable vacuum and air filtration unit, comprising a plurality of separately transportable modules and a means for locking the modules together during use into a rigidly interconnected chest containing an inlet, a debris deflector, a means for receiving debris stopped by the deflector, an electrostatic filter, a bag filter assembly, a HEPA filter assembly, and a means for drawing air through the inlet, deflector, electrostatic filter, bag filter and HEPA filter.

* * * * *

UNITED STATES PATENT AND TRADEMARK OFFICE

CERTIFICATE OF CORRECTION

PATENT NO. : 5,069,691

DATED : December 3, 1991

INVENTOR(S) : Terrell Travis, David Shagott, Gary Kruse, Daniel Sutherland, Blair Harber, Jr.

It is certified that error appears in the above-identified patent and that said Letters Patent is hereby corrected as shown below:

Column 4, line 15, delete "2" and insert --22--
Column 5, line 19, delete "5" and insert --56--

Signed and Sealed this

Fifth Day of July, 1994

*Attest:*

Bruce Lehman

BRUCE LEHMAN

*Attesting Officer*

*Commissioner of Patents and Trademarks*

US005069691A

REEXAMINATION CERTIFICATE (1991st)

United States Patent [19]

Travis et al.

[11] B1 5,069,691

[45] Certificate Issued Apr. 27, 1993

[54] PORTABLE FILTRATION UNIT

[75] Inventors: Terrell Travis, Alpharetta; David Shagott, Duluth, both of Ga.; Gary Kruse, Lincoln University, Pa.; Daniel Sutherland; Blair Harber, Jr., both of Ontario, Canada

[73] Assignee: Abatement Technologies, Duluth, Ga.

Reexamination Request:
No. 90/002,730, May 21, 1992

Reexamination Certificate for:

| | |
|---|---|
| Patent No.: | **5,069,691** |
| Issued: | **Dec. 3, 1991** |
| Appl. No.: | **613,212** |
| Filed: | **Nov. 14, 1990** |

[51] Int. Cl.[5] ..... B01D 50/00

[52] U.S. Cl. ..... 55/126; 55/467; 55/482; 55/484; 55/356; 55/350

[58] Field of Search ..... 55/126, 316, 482, 484, 55/320, 323, 324, 350, 467, 319

[56] References Cited

U.S. PATENT DOCUMENTS

| | | | |
|---|---|---|---|
| 324,575 | 8/1885 | Mertsheimer | 55/462 |
| 925,626 | 6/1909 | Dion | 55/136 |
| 2,295,984 | 9/1942 | Wilson | 55/472 |
| 2,927,659 | 3/1960 | Pabst et al. | 55/274 |
| 3,053,700 | 9/1962 | Kulp | 55/434 |
| 3,102,762 | 12/1961 | Norris | 257/295 |
| 3,172,747 | 12/1962 | Nodolf | 55/387 |
| 3,247,652 | 4/1966 | Annas et al. | 55/481 |
| 3,375,640 | 4/1969 | Pelosi, Jr. | 55/276 |
| 3,547,085 | 12/1970 | Kovacik | 122/491 |
| 3,802,168 | 4/1974 | Deckas | 55/473 |
| 3,804,942 | 4/1974 | Kato et al. | 55/126 |
| 3,828,530 | 8/1974 | Peters | 55/473 |
| 3,960,527 | 6/1976 | Goettl | 55/467 |
| 4,261,712 | 4/1981 | Kinkade | 55/126 |
| 4,590,884 | 5/1986 | Kreeger et al. | 118/308 |
| 4,591,368 | 5/1986 | MacDuff | 55/372 |
| 4,630,530 | 12/1986 | Eckstrom | 98/2.11 |
| 4,737,173 | 4/1988 | Kurdirka et al. | 44/276 |
| 4,787,922 | 11/1988 | Kulitz | 55/274 |
| 4,968,333 | 11/1990 | Ellis et al. | 55/341.1 |
| 5,102,435 | 4/1992 | Rau et al. | 55/467 |

FOREIGN PATENT DOCUMENTS

| | | | |
|---|---|---|---|
| 2459356 | 6/1975 | Fed. Rep. of Germany . | |
| 156517 | 9/1982 | German Democratic Rep. | 55/316 |
| 53-83171 | 7/1978 | Japan . | |

OTHER PUBLICATIONS

Aercology Air Cleaning Systems Advertisement, "Ugly Air" (Dec. 1988) (Exhibit 16).

Aercology Air Cleaning Systems Advertisement, (Feb. 1989) (Exhibit 17).

Certificate of Registration and Specimen for U.S. Trademark Registration No. 1,481,524 (filed Jan. 7, 1987).

Aercology, Inc. Brochure, "Modular Media Filter" (Aug. 1988) (Exhibit 13).

Aercology, Inc. Brochure, "Modular Media Filter" (May 1989) (Exhibit 14).

Jul. 1989, ECON, Omniforce Advertisement.

Sep. 1989, ECON, Omniforce Advertisement.

Dec. 1989, Asbestos Issues, Omniforce Advertisement.

Apr. 1988, ECON, Red Baron Advertisement.

Jul. 1989, Asbestos Abatement, Sentry Advertisment.

Aug. 1989, Asbestos Issues '89, Blue Max Advertisement.

Mar. 1989, Global Consumer Catalog "Red Baron" Units.

May 1992, Letter Orange County Lithograph re Global Consumer Services Catalog of Mar. 1989.

Sep. 1990, Aercology Inc. brochure, "Modular Media Filter".

Sep. 1990, Aercology Inc. brochure, inside 2 pages.

Apr. 1992, Aercology Inc. letter re dates of use of "Modular Media Filter" units of Exhibits 8 & 9.

1988 Catalog of Interstate Industrial Supplies Red Baron advertisement.

Publication ECON Apr. 1988, Patent Owner's advertisement.

*Primary Examiner*—Bernard Nozick

[57] ABSTRACT

A portable vacuum and air filtration unit, comprising: a

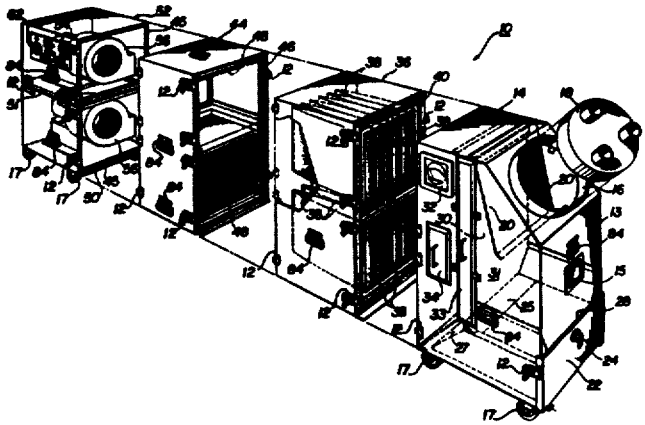

plurality of separately transportable modules and a means for locking the modules together during use, an air inlet located in one of the modules, a debris screen and a means for receiving debris stopped by the screen located in one of the modules, an electrostatic filter located in one of the modules, a bag filter assembly located in one of the modules, a HEPA filter assembly located in one of the modules, and a means for drawing a substantial volume of air through the inlet, screen, electrostatic filter, bag filter assembly and HEPA filter assembly.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1, 2 is confirmed.

New claims 3–20 are added and determined to be patentable.

*3. A unit according to claim 1 in which each of the modules has an upper surface and the air inlet is formed at a 45° angle to the upper surface of the module in which it is located, for facilitating attachment of the unit to an HVAC system.*

*4. A unit according to claim 1 in which the debris deflector spans the air inlet, for deflecting large solid debris vacuumed from HVAC ductwork.*

*5. A unit according to claim 1 in which the air drawing means comprises at least one motor coupled to at least one fan blower.*

*6. A unit according to claim 5 in which the air drawing means generates an airflow of at least 3500 CFM while operating at nominally 120 volts, enabling convenient operation in both residential and commercial locations.*

*7. A unit according to claim 1 in which the electrostatic filter and the air inlet are located in the same module, for permitting prefiltering of the debris entering through the air inlet.*

*8. A unit according to claim 1 in which the locking means comprises at least two cam locks for facilitating locking the plurality of separately transportable modules together.*

*9. A unit according to claim 1 in which the debris receiving means comprises a moveable drawer for providing access to and permitting removal of the received debris.*

*10. A unit according to claim 9 in which the moveable drawer defines a rear portion comprising a V-shaped area for trapping received debris.*

*11. A unit according to claim 1 further comprising a first door located in the module containing the electrostatic filter, for permitting removal of the electrostatic filter.*

*12. A unit according to claim 11 further comprising a second door located in the module containing the electrostatic filter, for permitting access to and unclogging of the electrostatic filter.*

*13. A unit according to claim 1 in which:*

*a. the debris deflector spans the air inlet, for deflecting large debris found in ductwork and preventing such debris from contacting any of the electrostatic filter, bag filter assembly, and HEPA filter assembly;*

*b. each of the modules has an upper surface and the air inlet is formed at an angle of approximately 45° to the upper surface of the module in which it is located, for facilitating attachment of the unit to an HVAC system; and*

*c. the debris receiving means comprises a moveable drawer for providing access to and permitting removal of the received debris.*

*14. A unit according to claim 13 in which the air drawing means comprises at least one motor coupled to at least one fan blower.*

*15. A unit according to claim 14 in which the air drawing means generates an airflow of at least 3500 CFM while operating at nominally 120 volts, enabling convenient operation in both residential and commercial locations.*

*16. A unit according to claim 15 in which the electrostatic filter and the air inlet are located in the same module, for permitting prefiltering of the debris entering through the air inlet.*

*17. A unit according to claim 16 in which the locking means comprises at least two cam locks for facilitating locking the plurality of separately transportable modules together.*

*18. A unit according to claim 1 in which:*

*a. each of the modules has an upper surface and the air inlet is formed at an angle of approximately 45° to the upper surface of the module in which it is located, for facilitating attachment of the unit to an HVAC system; and*

*b. the air drawing means comprises at least one motor coupled to at least one fan blower to generate an airflow of at least 3500 C.F.M. while operating at nominally 120 volts, enabling convenient operation in both residential and commercial locations.*

*19. A unit according to claim 1 in which the debris deflector comprises a perforated sturdy sheet.*

*20. A unit according to claim 3 in which the debris deflector comprises a perforated sturdy sheet.*

* * * * *

US005069691B1

REEXAMINATION CERTIFICATE (3047th)

United States Patent [19] [11] B2 5,069,691

Travis et al. [45] Certificate Issued Nov. 5, 1996

[54] PORTABLE FILTRATION UNIT

[75] Inventors: Terrell Travis, Alpharetta; David Shagott, Duluth, both of Ga.; Gary Kruse, Lincoln University, Pa.; Daniel Sutherland; Blair Harber, Jr., both of Ontario, Canada

[73] Assignee: Abatement Technologies, Duluth, Ga.

Reexamination Request:
No. 90/003,154, Aug. 9, 1993

Reexamination Certificate for:

| | |
|---|---|
| Patent No.: | **5,069,691** |
| Issued: | **Dec. 3, 1991** |
| Appl. No.: | **613,212** |
| Filed: | **Nov. 14, 1990** |

Reexamination Certificate B1 5,069,691 issued Apr. 27, 1993

Certificate of Correction issued Jul. 5, 1994.

[51] Int. Cl.[6] ..... B01D 50/00

[52] U.S. Cl. ..... 96/57; 55/350.1; 55/356; 55/467; 55/482; 55/484

[58] Field of Search ..... 55/467, 482, 484, 55/316, 356, 320, 323, 324, 342, 350.1, 433, 462, 418, 274, 429; 96/55, 57; 95/63, 69, 70, 900–903

[56] References Cited

U.S. PATENT DOCUMENTS

| | | | |
|---|---|---|---|
| 2,927,659 | 3/1960 | Pabst et al. | 55/274 X |
| 3,012,762 | 12/1961 | Norris | 257/295 |
| 3,343,344 | 9/1967 | Fairaizl et al. | 55/429 X |
| 3,425,189 | 2/1969 | Haselmayer | 55/418 X |
| 3,812,370 | 5/1974 | LaViolette | 55/316 X |
| 4,268,282 | 5/1981 | MacKenzie | 96/58 |
| 4,509,963 | 4/1985 | Jackson | 55/324 |
| 4,968,333 | 11/1990 | Ellis et al. | 55/356 X |
| 5,003,998 | 4/1991 | Collett | 134/22.12 |

OTHER PUBLICATIONS

OMNI/HVAC Cleaning System Specifications; U.S. Industrial Company; Jun., 1989.

Go With The Flow OMNI/HVAC Cleaning System; U.S. Industrial Company; 1989.

Indoor Air Systems, Inc. Brochure; May, 1987.

Red Baron–Blue Max Advertising Sheet; Global Consumer Services, Inc.; 1984.

Global Consumer Services Operation Manual; 1984.

Red Baron Red Hot ST2000 Lite Brochure; Global Consumer Services, Inc.; 1987.

*Primary Examiner*—Richard L. Chiesa

[57] ABSTRACT

A portable vacuum and air filtration unit, comprising a plurality of separately transportable modules and a means for locking the modules together during use, an air inlet located in one of the modules, a debris screen and a means for receiving debris stopped by the screen located in one of the modules, an electrostatic filter located in one of the modules, a bag filter assembly located in one of the modules, a HEPA filter assembly located in one of the modules, and a means for drawing a substantial volume of air through the inlet, screen, electrostatic filter, bag filter assembly and HEPA filter assembly.

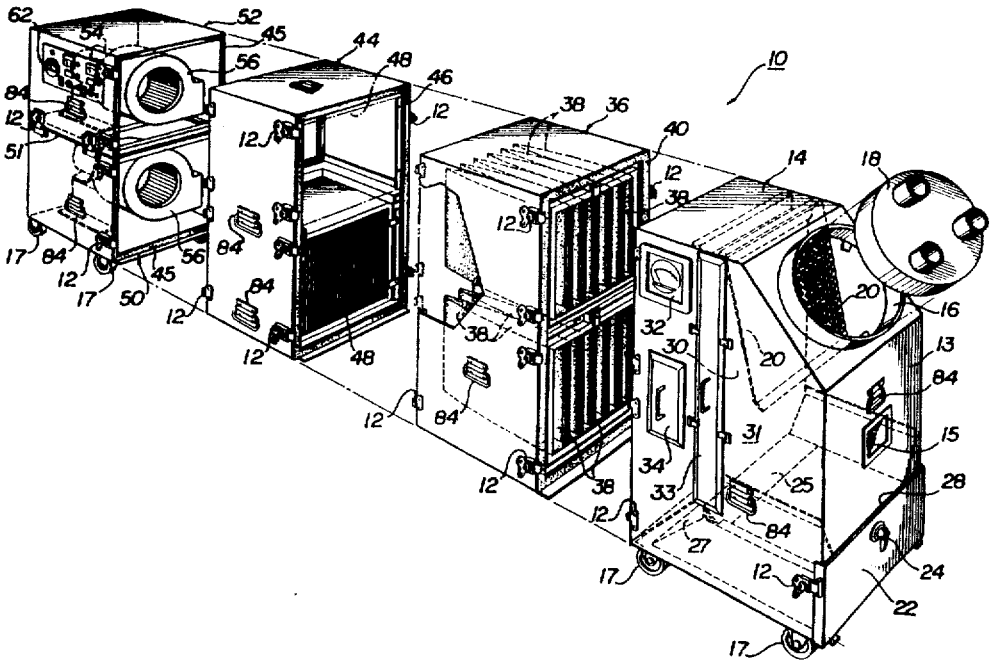

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 is confirmed.

New claims 21–30 are added and determined to be patentable.

*21. A unit according to claim 1 in which the debris deflector and at least one of the electrostatic filter and bag filter assembly are located in the same module.*

*22. A unit according to claim 1 in which the air inlet is the inlet for air into the unit and in which the debris deflector, air inlet, and at least one of the electrostatic filter and bag filter assembly are located in the same module.*

*23. A unit according to claim 1 in which the debris receiving means, the debris deflector, and at least one of the electrostatic filter and bag filter assembly are located in the same module.*

*24. A unit according to claim 1 in which each of the modules includes means, comprising a gasket, for sealing it to adjacent modules when the unit is operating.*

*25. A unit according to claim 1 in which each of the modules has a floor and is of substantially the same height to facilitate transport and attachment of the modules.*

*26. A unit according to claim 1 in which the debris receiving means is positioned to receive debris that has been diverted out of the stream of air created by drawing the substantial volume of air.*

*27. A unit according to claim 9 in which the debris receiving means further comprises a gasket attached to the movable drawer to seal it to the module in which it is located during use.*

*28. A unit according to claim 27 in which the debris receiving means further comprises a locking handle attached to the moveable drawer.*

*29. A unit according to claim 1 in which:*

*a. the module in which the air inlet is located has a surface integrally forming a part thereof and the air inlet is defined by an opening in that surface;*

*b. both the debris deflector and the debris receiving means are located in the same module as the air inlet and the debris deflector is positioned directly above the debris receiving means during use;*

*c. the debris receiving means is a moveable drawer for providing access to and permitting removal of the received debris; and*

*d. the plurality of separately transportable modules are of substantially identical height.*

*30. A portable vacuum and air filtration unit for attachment to HVAC ductwork containing a wide range of debris, comprising:*

*a. a plurality of separately transportable modules of substantially identical height, each having a surface integrally forming a part thereof;*

*b. a means for locking the modules together during use;*

*c. an air inlet defined by an opening located in the surface of one of the modules;*

*d. a means for treating the wide range of debris found in the HVAC ductwork, comprising:*

*i. a debris deflector and a means for receiving debris stopped by the deflector, both located in the same module as the air inlet and the debris deflector positioned within the module but not in the opening of the surface defining the air inlet; and*

*ii. a cascade of filters comprising:*

*A. an electrostatic filter located in one of the modules;*

*B. a bag filter assembly located in one of the modules; and*

*C. a HEPA filter assembly located in one of the modules; and*

*e. a means for drawing a substantial volume of air through the inlet, deflector, electrostatic filter, bag filter assembly and HEPA filter assembly.*

* * * * *